US006149832A

United States Patent [19]

Foister

[11] Patent Number: 6,149,832

[45] Date of Patent: Nov. 21, 2000

[54] STABILIZED MAGNETORHEOLOGICAL FLUID COMPOSITIONS

[75] Inventor: Robert Thomas Foister, Rochester Hills, Mich.

[73] Assignee: General Motors Corporation, Detroit, Mich.

[21] Appl. No.: 09/178,755

[22] Filed: Oct. 26, 1998

[51] Int. Cl.[7] ..... H01F 1/44

[52] U.S. Cl. ..... 252/62.52; 252/62.51 R

[58] Field of Search ..... 252/62.52, 62.56, 252/62.51 R

[56] References Cited

U.S. PATENT DOCUMENTS 5,667,715 9/1997 Foister ..... 252/62.52

*Primary Examiner*—C. Melissa Koslow
*Attorney, Agent, or Firm*—George A. Grove

[57] ABSTRACT

Magnetorheological fluids containing carbonyl iron particles with surface hydroxyl groups and high specific surface area in combination with nonpolar vehicles such as polyalpha-olefins and glycol esters can be formulated to resist particle separation under high separation force applications. When the nonpolar vehicle having a suitably high molecular weight is used, the fluids may be used at working temperatures of the order of 200° C.

9 Claims, 3 Drawing Sheets

STABILIZED MAGNETORHEOLOGICAL FLUID COMPOSITIONS

TECHNICAL FIELD

This invention pertains to magnetorheological fluid compositions that display good stability when subjected to ordinary sedimentation force or to strong centrifugal separation forces. This invention also provides such fluids that display such stability at temperatures of about 200° C. to 250° C.

BACKGROUND OF THE INVENTION

Magnetorheological (MR) fluids in general comprise a dispersion of low coercivity, ferromagnetic particles in a liquid vehicle. In the absence of a significant magnetic field, the fluid has an off-state viscosity, and in the presence of a suitable magnetic field (on-state), the fluid gels and requires a substantial torque or yield stress to commence flow. The particles are often small iron particles while a broad range of nonmagnetic liquids have been used or proposed for MR fluids. In some applications lubricants are mixed with the liquid vehicle when lubrication properties are required. Additives may also be employed to maintain the suspension of the particles in the liquid and to prevent coagulation of the particles.

U.S. Pat. No. 5,667,715 to Foister and assigned to the assignee of this invention describes a family of magnetorheological (MR) fluids that are very useful because they display a high ratio of the torque output generated by the magnetically activated MR fluid to the torque or output for the same fluid in the unactivated or off state. It is usually desired that this ratio, called the "turn-up ratio", be maximized under given operating conditions because one usually wants the off-state viscosity to be of a relatively low value while a relatively high on-state (magnetic field on) yield stress is desired to accomplish the intended function of an MR device. The '715 patent MR materials provide high turn up ratio in part by utilizing magnetic particles of two distinct complementary sizes dispersed in a suitable liquid vehicle.

In the automotive field, MR fluids are being evaluated for use in shock absorbers and other suspension devices. MR fluids are also being evaluated for use in clutches such as cooling fan clutches and in powertrain transmissions. In MR suspension devices, the operating temperatures normally do not exceed about 150° C., and only normal gravitation forces act on the fluid to induce separation of the suspended particles. Many of the compositions disclosed in the '715 patent are satisfactory for such relatively low temperature and low separation force applications. However, some clutch applications, particularly plate applications utilizing multiple flat plates involve centrifugal forces that cause particle separation. Further, some automotive underhood applications involve operating temperatures of 200° C. to 250° C. Heretofore there have been no MR formulations having suitable stability for such demanding applications.

SUMMARY OF THE INVENTION

This invention provides a magnetorheological fluid that is stable under prolonged exposure to forces that would otherwise separate the magnetic particles from the liquid vehicle. This MR fluid may also be formulated for stability at elevated temperatures of, e.g., 250° C.

The fluid comprises a dispersion of low coercivity, generally spherical magnetic particles in a suitable liquid vehicle. Preferably the particles are carbonyl iron particles (i.e., made by decomposition of iron pentacarbonyl) with surface hydroxyl groups.

In some applications it will be preferred that the iron particles be subjected to a chemical reduction step, e.g., reduction in a hydrogen atmosphere, to promote the increase of hydroxyl groups on the surface of the particle and to soften the particles.

The iron particles are used in either one or two groups of particle sizes where each of said groups has a mean diameter in the range of about one to fifteen micrometers. At least one group of particles is small particles having a mean diameter in the range of one to two micrometers. The particles are further characterized by a standard deviation in diameters less than half of said mean value and a specific surface area greater than four square meters per cubic centimeter. The group of small particles (1 to 2 micrometers in mean diameter) preferably constitutes at least 20% by volume of said MR fluid. When a second group of iron particles is employed in the fluid, the mean diameter of the second group is preferably less than fifteen micrometers and at least three to four times the mean value of the small particle group. The specific surface area of the larger particles will usually be less than the area of then small particles. It is preferred that the larger particles also have surface hydroxyl groups.

A qualitative and quantitative analysis of hydroxyl groups is conducted as described below. Suitable iron particles contain at least about $1\times10^{19}$ hydroxyl groups per square meter of particle surface area.

The liquid vehicle is an important complementary constituent with respect to the magnetic particles. At least 80% by volume of the liquid is a composition incapable of forming hydrogen bonds with said hydroxyl group containing particles. The combination of surface hydroxyl groups bearing small particles and the nonpolar liquid vehicle is believed to permit the formation of a hydrogen bonded particle network resisting sedimentation and centrifugal separation. Preferably, the liquid vehicle is a composition selected from the group consisting of aliphatic hydrocarbons and glycol esters. The liquid vehicle preferably has a viscosity at 40° C. no greater than about 100 cP. Further, said liquid vehicle constituent when formulated with a dispersed group of small particles has a yield stress at 25° C. (in the absence of a magnetic field) of at least 200 Pa. When the MR fluid is expected to experience operating temperatures of 200° C., then it is preferred that the liquid vehicle have a molecular weight above 500 and preferably in the range of about 500 to 1000.

DESCRIPTION OF THE PREFERRED EMBODIMENT

Figure 1:
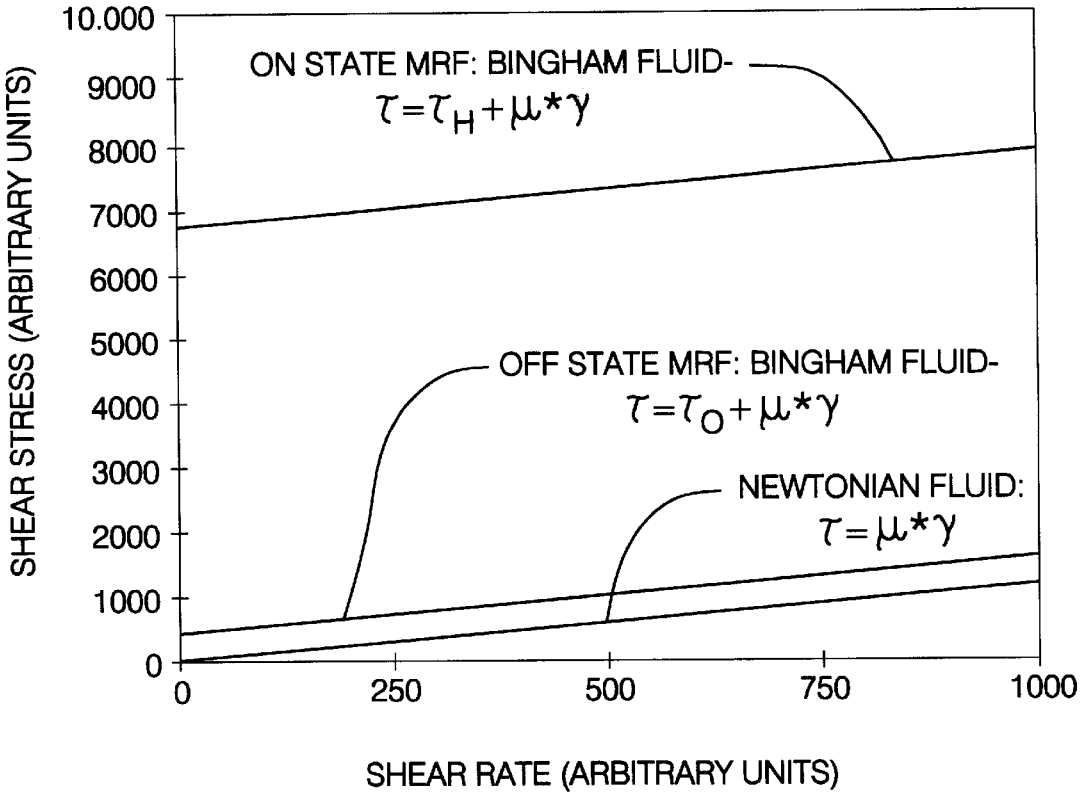
FIG. 1 is a graph illustrating the shear stress/shear rate behavior of typical magnetorheological fluids.

FIG. 1 is a graph of shear stress (arbitrary units) vs. shear rate (arbitrary units) illustrating the behavior of typical magnetorheological fluids and components. Most such fluids function essentially as Bingham fluids. In an ambient gravitational field but in the absence of a magnetic field, they display a shear stress that increases generally linearly as the shear rate on the fluid is increased. This property is indicated in FIG. 1. Bingham fluids display a shear stress at zero shear rate, whereas a Newtonian fluid (an idealized fluid) has no shear stress at zero shear rate. When MRF Bingham fluids are subjected to a magnetic field, the shear stress vs. shear rate relationship is transposed up the shear stress axis so that the shear stress required to commence shear of the fluid is substantially increased. In general, the slope of the shear stress vs. shear rate curve for the MRF fluid in the applied magnetic field (in the "on" condition) is substantially parallel to the same curve for the "off" state MRF fluid. The values of the shear stress at zero shear rate for both the "on" state and "off" state fluids are the same values that are used in calculating the turn-up ratio which has been described above in this specification.

In accordance with the invention, it is preferred to formulate a MR fluid using carbonyl iron particles of two different size range distributions. The small carbonyl particles have a mean diameter in the range of one to one and three-quarter micrometers and a standard deviation in the diameters of the small particle group that is less than half of the mean value of the diameters. Furthermore, the small carbonyl iron particles have a specific surface area that is greater than about 4 $m^2/cm^3$. It is preferred that the group of small particles constitute at least 20% by volume of the magnetorestrictive fluid. A further characteristic of the carbonyl iron particles employed in this invention is that they contain surface hydroxyl groups. The presence of such hydroxyl groups and a quantitative determination of hydroxyl group content can be made as will be described below.

Some benefits of this invention can be obtained by using such small diameter carbonyl iron particles as the sole magnetic particle dispersed in the fluid. However, as described in U.S. Pat. No. 5,667,715, it is often preferred to use a mixture of two different sizes of iron particles to obtain an improved turn-up ratio. Thus, a second group of carbonyl iron particles is preferably employed in the practice of this invention where such particles have a mean diameter larger than one and three-quarters micrometers but less than about 15 micrometers. The larger particles have a mean diameter at least five times the mean diameter of the small particle group for maximum improvement of turn-up ratio. Again, it is preferred that the standard deviation of the diameters of the larger group of particles be less than half of the mean value of the diameters of the larger particles. While it is preferred that the small diameter carbonyl iron particles be employed in an amount of at least 20% by volume of the total fluid, the total particle content can be up to 45% to 50% by volume of the fluid.

The practice of the invention as regards carbonyl iron particle selection is illustrated with suitable iron particles from two sources. One source is ISP Technologies, Inc. and a second source is the BASF Company. The following tables illustrate suitable iron particle material designations and contain data representing the volume average particle diameter, the standard deviation of the average particle diameter, and the specific surface area for the respective particles. The particles are identified by the trade designation of their manufacturer. Some of the particles have been subjected to reducing atmospheres.

TABLE 1

Properties of Carbonyl Iron Particle Distributions

| Material Designation | Volume Average Particle Diameter ($\mu$m) | Standard Deviation ($\mu$m) | Specific Surface Area ($m^2/cm^3$) |
|---|---|---|---|
| BASF HS*@ | 1.61 | 0.489 | 4.15 |
| ISP 3700@ | 3.06 | 1.45 | 3.06 |
| BASF SU% | 1.59 | 0.522 | 4.33 |
| BASF HL@ | 2.24 | 0.694 | 3.08 |
| BASF CM**% | 10.0 | 5.24 | 1.06 |
| BASF SM% | 2.35 | 0.857 | 3.14 |

*Standard MRF "Small Particle" Component
**Standard MRF "Large Particle" Component
%Reduced Grade
@Unreduced Grade As indicated above, it is preferred that the iron particles contain surface hydroxyl groups. The following is how a quantitative determination of hydroxyl group content can be undertaken.

Quantitative Determination of Hydroxyl Group Content

The hydroxyl surface concentration for the carbonyl Fe can be determined from absorption data. This number was obtained from chemisorption data of a reactive surfactant (an ethoxylated tallow amine, "T-15"). Essentially, a surfactant molecule reacts with an OH group on the Fe surface to produce an ether-type linkage plus one molecule of free water—a typical "condensation" reaction: M—OH+ROH→M—OR+$H_2O$, where M is the Fe surface and ROH is the surfactant. This reaction can be monitored with near IR spectroscopy (i.e., following the depletion of surfactant in solution). It has been found that 0.00425 g of tallow amine surfactant reacts per g of a particular group of Fe particles. The surfactant has a MW of 480 g/mol. This means that there are $8.9\times10^{-6}$ mol reactive sites (i.e., OH groups) per g of Fe. Using Avogadro's Number and the specific surface area appropriate to the particular carbonyl Fe particles (BASF CM), it is calculated that there are $3.9\times10^{19}$ OH groups per square meter of surface area for the large particle carbonyl Fe. A similar determination for a small particle (BASF HS) carbonyl Fe gives a value of $6.8\times10^{19}$ OH groups per square meter. By comparison, hydrophilic fumed silica has from 3.5 to $4.5\times10^{18}$ OH groups per square meter of surface area (from *Cab-O-Sil Fumed Silica Properties and Functions*, p. 8, Cabot Corporation, 1987). So, the carbonyl Fe particles (BASF CM and HS) have roughly 10 to 15 times more OH groups per unit area than the fumed $SiO_2$. This is consistent with what one would expect on the basis of the supposition that the yield stress in the subject self-stabilizing suspensions of small particle carbonyl Fe is the result of hydrogen bonding.

Figure 2:
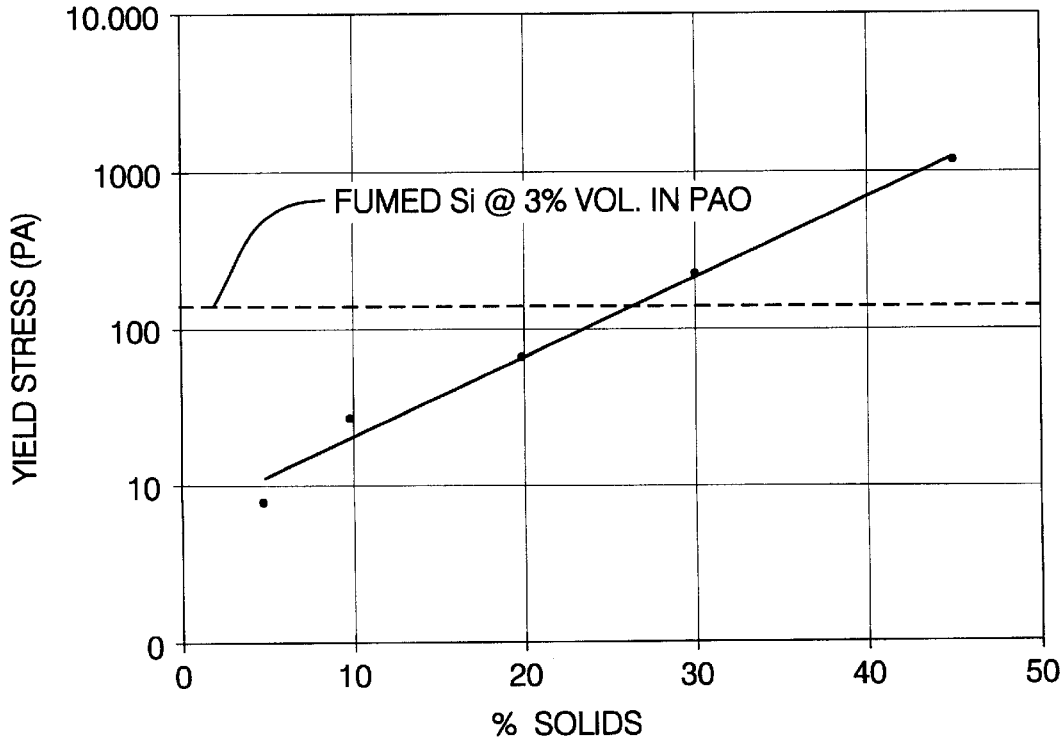
FIG. 2 is a graph showing the effect of solids concentration on yield stress of small particle magnetorheological fluids of this invention.

Referring to FIG. 2, it is apparent that it takes about 3%/vol fumed silica to get a yield stress of 130 Pa, while it takes 30%/vol small particle Fe to get an equivalent yield stress. Using the specific surface area of 420 sq. meters/cc of fumed silica, it is calculated that at 3%/vol, there are 11.34 sq. m. of fumed silica surface per cc of fluid volume. By comparison, with the small particle carbonyl Fe at 30%/vol, there are only 1.25 sq. m. of Fe surface per cc of fluid volume. This means that there is 9.1 times more silica surface area than Fe surface area per cc of fluid. However, the yield stress is equivalent, so it is likely that there are approximately an order of magnitude more hydrogen bonding sites on the Fe than on the silica. Referring to the numbers above, this is in fact what was found in the adsorption experiments.

The liquid vehicle of the MR fluid is also an important constituent. It is preferred that a preponderance of the vehicle, at least 80% by volume of the total liquid vehicle content, be a liquid that is formed of a composition that is generally incapable of forming hydrogen bonds with the hydroxyl group containing particles. Suitable liquid vehicles comprise materials such as the aliphatic hydrocarbons and glycol esters. An example of suitable aliphatic hydrocarbons is a family of polyalphaolefins (PAO) from the Mobil Corporation. These materials are generally based on the monomer 1-decene, $CH_3—(CH_2)_7—CH{=}CH_2$. The following table lists a group of such materials of polyalphaolefins from Mobil Corporation as well as a preferred glycol ester number and certain of the vehicle properties that are important to the practice of this invention.

TABLE 2

Properties of Fluid Phase Components
(Preferred Low Volatility MRF Clutch Materials are Shaded)

| Fluid Designation | Viscosity (cP @ 40° C.) | Evaporation Rate (%/min @ 250 ° C.) | Mw | Mw/Mn |
|---|---|---|---|---|
| SHF 21 | 4.2 | — | 283 | 1.00 |
| SHF 41 | 14.8 | 1.59 | 434 | 1.01 |
| SHF 61 | 23.7 | 0.704 | 549 | 1.04 |
| SHF 82 | 39.2 | 0.128 | 635 | 1.04 |
| SHF 101 | 68 | 0.106 | 723 | 1.05 |
| SHF 401 | 340 | 0.0929 | 2719 | 1.55 |
| Uniflex 206* | 28 | 0.371 | 632 | — |

SHF refers to polyalphaolefins (PAO) from Mobil. These materials are based on the monomer 1-decene. SHF 21 is primarily (97%) dimer, and 41 is primarily (90%) trimer. The remaining materials have increasingly broad MW distributions, consisting of trimers, tetramers, pentamers, etc. The increments in the Mobil SHF product line (41, 61, etc.) are chosen on the basis of kinematic viscosity at 100° C. Thus, "SHF 41" has a kinematic viscosity of approximately 4 cst at 100° C., "SHF 61" a kinematic viscosity of 6 cst, etc.

*A mixture of esters and diesters from neopentyl glycol based esterification of tall oil fatty acids (Union Camp, Inc.). The primary component is neopentyl glycol dioleate (28%). A source of pure neopentyl dioleate is Henkel Proeco 2965. This material has the advantage of a somewhat lower (20%) viscosity than the more heterogeneous Uniflex 206.

The fluids designated SHF 21, SHF 41 and SHF 61 are suitable for low temperature applications. They are, in general, nonpolar fluids that do not interact substantially with the hydrogen bond among particles. For high temperature applications of the order of 200° C., it is preferred to use fluids such as SHF 82 and SHF 101 because they have a suitably low viscosity at 40° so as to contribute low off state viscosity to the fluid. On the other hand, they have a low evaporation rate at 250° C. which contributes to the stability of the MR fluid. Accordingly, polyalphaolefins having a molecular weight in the range of about 600 to 750 are preferred for use at temperatures of the order of 200° C. Where a higher viscosity can be tolerated, SHF 401 and SHF 1001 may be suitable. An example of another suitable liquid vehicle for the MR fluid formulations is Uniflex 206, a mixture of esters and di-esters from neopentyl glycol-based esterification of tall oil fatty acids, a product of Union Camp, Inc. The primary component of this liquid is neopentyl glycol dioleate (28% by volume of the total fluid). A source of pure neopentyl dioliate is Henkel Proeco 2965. Pure neopentyl dioliate offers the advantage of a lower viscosity than the Uniflex 206 mixture.

In some MRF applications, such as in automotive suspension dampers, it is desirable to use a lubricant in the liquid vehicle. Following is a tabulation of exemplary lubricants for use in the subject stabilized MR fluids. These lubricants may also be used in high temperature applications.

| Fluid Designation | Viscosity, CP @ 40° C. | Evaporation Rate %/min @ 250° C. | Mw |
|---|---|---|---|
| Uniflex DOS* | 11.7 | 2.55 | 328 |
| Uniflex 171** | 6.4 | 12.5 | 295 |
| Uniflex 193*** | 8.3 | 3.56 | 394 |

*Dioctyl Sebacate, considered the lubricant base stock, essentially pure bis(2-ethylhexyl) ester of decanedioic acid.

**Methyl Tallate Ester, a lubricity additive. Primarily (93.7%) methyl linoleate, with 2.8% methyl stearate and 1.1% methyl palmitate. Also contains residual organic acid.

***Octyl Tallate Ester, a lubricity additive. Primarily 2-ethylhexyl linoleate, with 2.6% oxidized branched ester, and traces of 2-ethylhexyl oleate and 2-ethyl-1-hexanol.

These and/or other suitable lubricity additives are used in suitable amounts in the nonpolar liquid vehicle.

In prior art fluids, it was often preferred to coat the surface of the magnetic particles to reduce the tendency for coagulation of the particles during utilization of the MR fluids. Examples of such coatings were surfactants such as tallowamine surfactants. This treatment was found to minimize or eliminate coagulation and clumping of the iron particles in magnetorheological fluids in their operation. Usually, the larger magnetic particles were treated in this way. However, this invention utilizing the combination of a particular hydroxyl surface group containing particles with specific nonpolar vehicles reduces or eliminates the need for such surfactant treatment in many applications.

It is also a practice in prior art MR fluid formulations to disperse fumed silicas as a thixotrope in the fluid. A high shear dispersion of ultrafine silica particles into the vehicle formed a thixotropic medium that stabilized the dispersion of the magnetic particles. This was taught, for example, in U.S. Pat. No. 5,667,715. Again, however, in accordance with the practice of this invention, it is often possible to reduce or eliminate the fumed silica content and maintain a stable MR fluid. Typically, a MR fluid prepared in accordance with this invention need contain no more than about three percent by volume of fumed silica.

In the preparation of the MR fluid, the liquid vehicle and the solid magnetic particles are mixed for six to eight hours and then degassed before use. The properties of several such particle vehicle mixtures are described below.

A feature of this invention is the stability of the small particle or small and large particle mixtures with the specific liquid vehicles in the MR fluids. It is found that when hydroxyl group-containing, carbonyl iron particles are suspended in suitable nonpolar liquids in accordance with this invention, the resulting fluids resist sedimentation under normal gravity and furthermore resist centrifugal separation in applications such as clutch applications.

Figure 4:
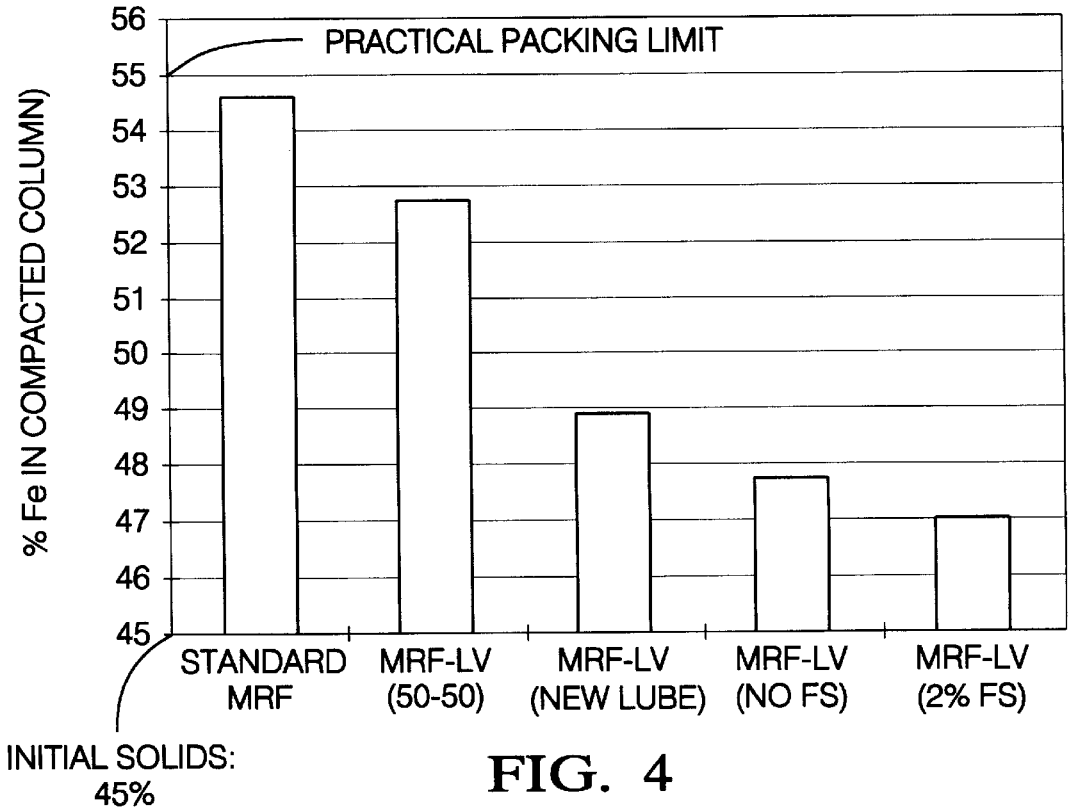
FIG. 4 is a bar graph of the final volume fraction of carbonyl iron particles after centrifuging of MR fluids of this invention.

A series of MRF fluids were prepared as follows to demonstrate the stability characteristic or these fluids. Each fluid was prepared to contain a total of 45% by volume carbonyl iron particles. Reference will be had to FIG. 4.

A standard MR fluid was prepared to contain 22.5% by volume of BASF CM relatively large diameter iron particles and 22.5% by volume of BASF HS small diameter carbon particles in a liquid. The liquid consisted of, by volume, 20% SHF 41 PAO, 40% dioctyl sebacate and 40% Uniflex 192. In addition, Cab-o-Sil M5 fumed silica thixotropic additive was added in the amount of 7% by volume of the liquid. This "standard MRF formulation" is based on the disclosure of U.S. Pat. No. 5,667,715 and used in this experiment as a baseline MRF formulation.

A fluid was then prepared in accordance with this invention. This fluid, designated MRF-LV (50:50), was a 50—50 mixture of BASF CM large particles and BASF HS small particles to a total particle content of 45% by volume of the fluid in polyalphaolefin SHF-82. This fluid also contained 0.5% by volume of Cab-o-Sil M5 fumed silica.

A third magnetorheological fluid was prepared, designated MRF-LV (new lube), containing a 50—50 mixture of BASF CM large particles and BASF HS small particles, 7% Cab-o-Sil fumed silica and the liquid consisted of 50% PAO SHF 82 and 50% Uniflex 206 lubricant.

A fourth MRF was prepared, designated MRF-LV (no FS, for no fumed silica). MRF-LV (no FS) consisted of 50% BASF CM, 50% BASF HS particles and the liquid was entirely PAO SHF 82.

A fifth MRF was prepared, designated MRF LV(2% FS). This fluid consisted of BASF HS small particles, PAO SHF 82 and 2% Cab-o-Sil M5 fumed silica.

The respective five MRF formulations were each centrifuged under a load of 500 times the force of gravity for one hour. The graph of FIG. 4 depicts the results of the compaction of the iron particles in the respective fluids after one hour of centrifuging.

It is seen that the standard MR fluid compacted such that the particles were in a column that was approximately 54.5% by volume particles, with the practical packing limit of the particles being about 55% by volume iron particles. Thus, it is seen that the magnetic particles of the standard MR fluid segregated under the severe centrifuging operation nearly to the packing limit of the material itself. Such a fluid would not be preferred for use in an application in which the MR fluid would be subject to such centrifugal force.

The basic MRF-LV material compacted somewhat less than the standard MRF. The final compaction was between 52% and 53%. The MRF-LV (new lube) material performed better. The compaction of this MR fluid was just under 49%. The MRF-LV with no fumed silica experienced a compaction of 47% to 48%, while the MRF-LV with 2% fumed silica underwent very little compaction. It reached a level of just under 47%, a material that would be suitable for use in an MRF application involving application of very severe centrifugal forces.

Figure 3:
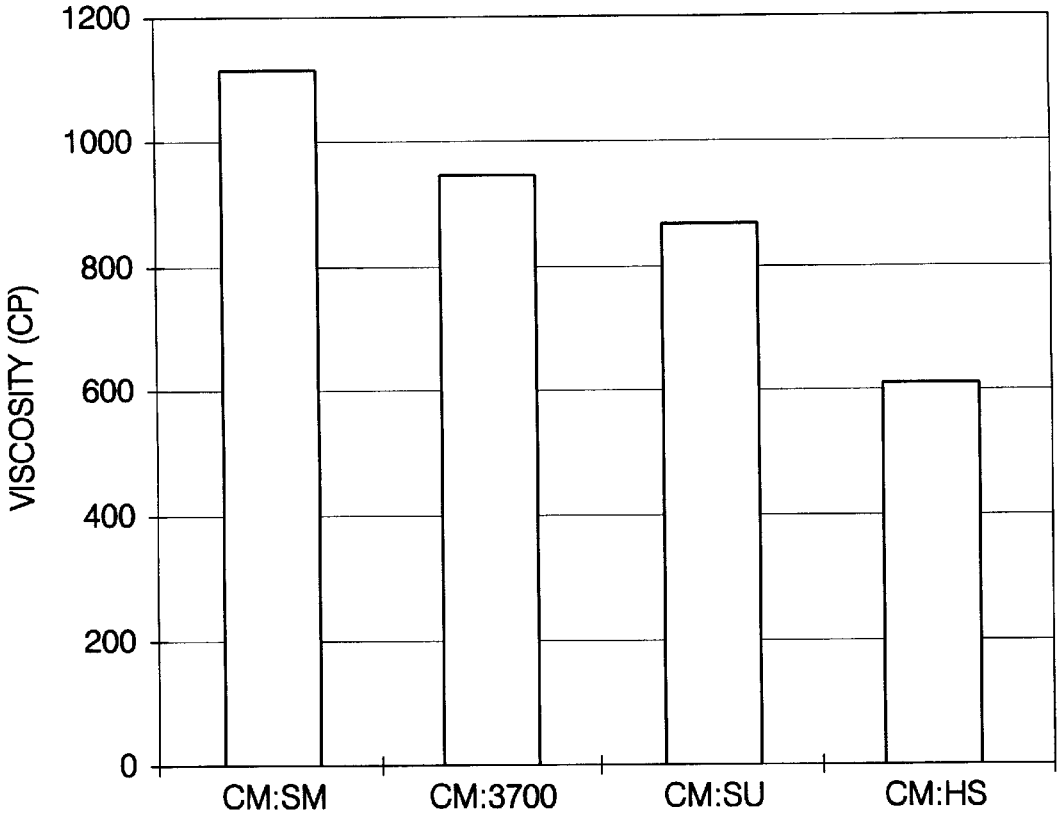
FIG. 3 is a bar graph of viscosity in cP at 400° C. and 45% solids content of MR fluids of this invention.

In addition to providing stability against sedimentation and separation due to centrifugal forces, it is desired to produce an MRF that has a relatively low viscosity in the "off" state. FIG. 3 shows the "off" state dynamic viscosity and centipoise of MR fluids that are formulated to contain 45% solids of equal mixtures of large and small particle combinations in a polyalphaolefin vehicle, SHF-82. The respective combinations are the designations for the carbonyl iron particles found in the above table. The "on" shear stresses for these bimodal particle size fluids are several times as high as the "off" state viscosity. Although the subject fluids with hydroxyl group containing iron particles and nonpolar vehicles provide unexpected resistance to particle separation, they also offer the high turn-up performance described in the '715 patent when suitable bimodal particles are used.

Figure 5:
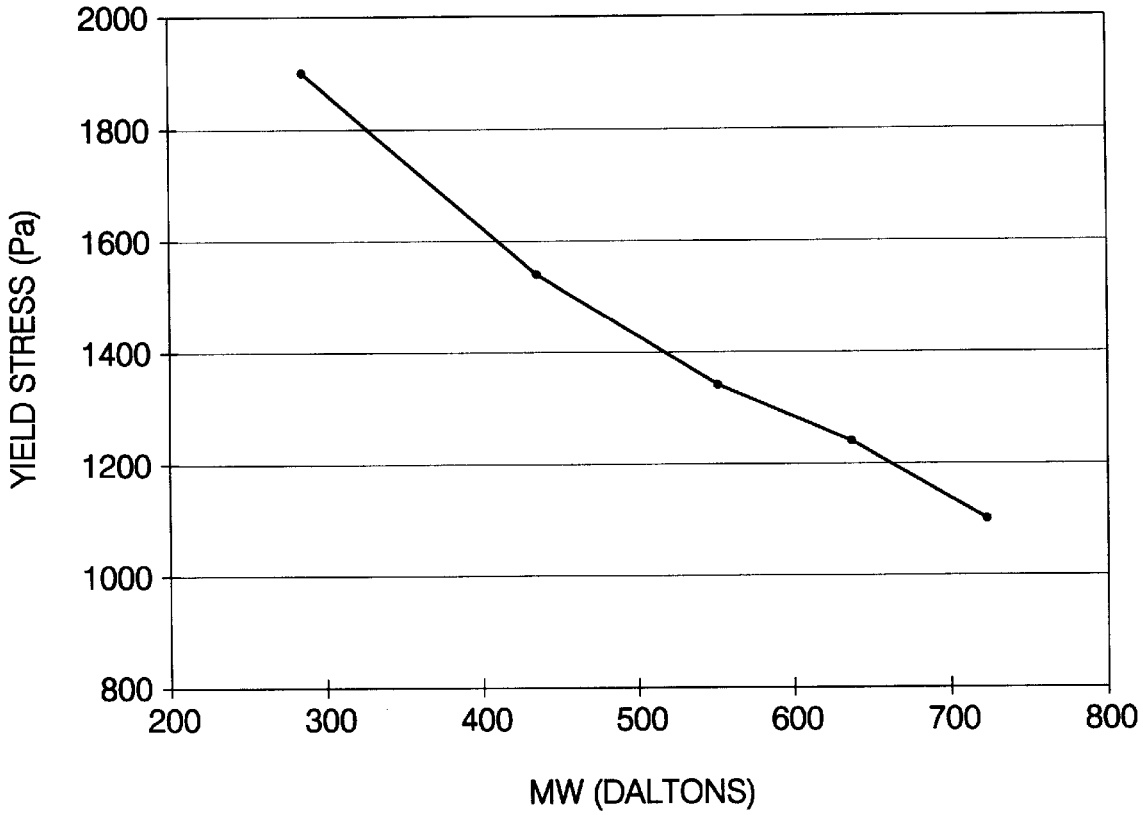
FIG. 5 is a graph of yield stress in Pascals (Pa) of MR fluids of this invention versus the molecular weight of the polyalphaolefin vehicle.

When a MRF application requires high stability without high turn-up ratio, a formulation using entirely small particles (about one to two microns in mean diameter) may be prepared. FIG. 5 illustrates the yield stresses produced by combinations of BASF HS small particles with varying molecular weight polyalphaolefins. In general, the yield stress of these MR fluids decrease as the mw of the vehicle increases. But the thermal stability of the fluid increases as the evaporation rate of the vehicle decreases.

Two examples of MR fluids which utilize the approach described in this patent application have been formulated and tested in an automotive clutch. The first example, denoted MRFC-1, consists of an equal mixture of BASF CM and BASF HS carbonyl Fe, in an amount which constitutes 45%/vol solids, suspended in SHF 82 polyalphaolefin, with 0. 5%/wt Cab-o-Sil fumed Si. The second example, denoted MRFC-2, is also 45% solids/wt, but with a solid phase consisting entirely of BASF HS carbonyl Fe, suspended in SHF 82, with no fumed Si. The following table summarizes basic properties of these two materials.

| MR Fluid | Viscosity (cP @ 40° C.) | Off State Yield Stress (Pa) | Yield Stress (Pa @ 1 Tesla Applied Magnetic Flux Density) |
|---|---|---|---|
| MRFC-1 | 751 | 514 | $69 \times 10^3$ |
| MRFC-2 | 616 | 1010 | $48 \times 10^3$ |

The clutch was subjected to operating conditions which generated continuous use temperatures in the range of 120° C. to 200° C., with maximum temperatures exceeding 300° C. for short durations, for total times of up to 100 hours. Input speeds were such that centrifugal forces in excess of 500 g were experienced routinely. No deterioration in off state or magnetically-activated performance was observed. In addition, upon tear down at the conclusion of the tests, less than 2% change in solids volume fraction was measured in MR fluid taken from the clutch active areas, indicating negligible loss of the fluid phase due to volatization.

Thus, it is shown that the combination of carbonyl iron particles containing surface hydroxyl groups with a nonpolar solvent selected from the group consisting of aliphatic hydrocarbons and glycol esters provide magnetorheological fluids that resist particle separation. Moreover, when the polyalphaolefin or the glycol ester is selected to have a molecular weight such that its evaporation rate in percent per minute at 250° C. is in the range of about 0.1 to 0.13% per minute, the fluid displays such good stability at operating temperatures of the order of 200° C.

While this invention has been described in terms of some specific embodiments, it will be appreciated that other forms can readily be adapted by one skilled in the art. Accordingly, the scope of this invention is to be considered limited only by the following claims.

What is claimed is:

1. A magnetorheological fluid comprising a dispersion of low coercivity, generally spherical magnetic particles in a liquid vehicle, said particles consisting essentially of carbonyl iron particles with at least about $10^{19}$ surface hydroxyl groups per square meter of surface area, said fluid comprising at least 20% by volume of a first size group of said particles characterized by a mean diameter in the range of one to two micrometers, a standard deviation of particle diameters of less than half of said mean diameter value and a specific surface area greater than four square meters per cubic centimeter, said fluid optionally comprising a second size group of said particles characterized by a mean diameter, larger than the mean diameter of said first size group, but not larger than about 15 micrometers, the standard deviation of the diameters of said second size group being less than half of their mean diameter value, said liquid vehicle comprising at least 80% by volume of a composition incapable of forming hydrogen bonds with said hydroxyl group containing particles, said composition being selected from the group consisting of aliphatic hydrocarbons and glycol esters, said vehicle having a viscosity at 40° C. no greater than 100 cP, and said liquid vehicle plus dispersed group of small particles having a yield stress at 25° C. in the absence of a magnetic field of at least 200 Pa.

2. A magnetorheological fluid as recited in claim 1 having stability at temperatures up to about 200° C., said liquid vehicle composition having a molecular weight of at least 500.

3. A magnetorheological fluid as recited in claim 1 having stability at temperatures up to about 200° C., said liquid vehicle composition having a molecular weight in the range of about 500 to 1000.

4. A magnetorheological fluid comprising a dispersion of low coercivity, generally spherical magnetic particles in a liquid vehicle, said particles consisting essentially of carbonyl iron particles with at least about $10^{19}$ surface hydroxyl groups per square meter of surface area, said fluid comprising at least 20% by volume of a first size group of said particles characterized by a mean diameter in the range of one to two micrometers, a standard deviation of particle diameters of less than half of said mean diameter value and a specific surface area greater than four square meters per cubic centimeter, said fluid optionally comprising a second size group of said particles characterized by a mean diameter, larger than the mean diameter of said first size group, but not larger than about 15 micrometers, the standard deviation of the diameters of said second size group being less than half of their mean diameter value, said liquid vehicle comprising at least 80% by volume of a polyalphaolefin polymer having an average molecular weight in the range of about 500 to 1000, said vehicle having a viscosity at 40° C. no greater than 100 cP, and said liquid vehicle plus dispersed group of small particles having a yield stress at 25° C. in the absence of a magnetic field of at least 200 Pa.

5. A magnetorheological fluid as recited in any of claims 1 or 4 where said fluid comprises a maximum of three percent by volume of fumed silica.

6. A magnetorheological fluid as recited in claim 4 in which the molecular weight of said polyalphaolefin is in the range of about 600 to 750.

7. A magnetorheological fluid comprising a dispersion of low coercivity, generally spherical magnetic particles in a liquid vehicle, said particles consisting essentially of carbonyl iron particles with at least about $10^{19}$ surface hydroxyl groups per square meter of surface area, said fluid comprising at least 20% by volume of a first size group of said particles characterized by a mean diameter in the range of one to two micrometers, a standard deviation of particle diameters of less than half of said mean diameter value and a specific surface area greater than four square meters per cubic centimeter, said fluid further comprising a second size group of said particles characterized by a mean diameter, larger than the mean diameter of said first size group, but not larger than about 15 micrometers, the standard deviation of the diameters of said second size group being less than half of their mean diameter value, said liquid vehicle comprising at least 80% by volume of a polyalphaolefin polymer having an average molecular weight in the range of about 500 to 1000, said vehicle having a viscosity at 40° C. no greater than 100 cP, and said liquid vehicle plus dispersed group of small particles having a yield stress at 25° C. in the absence of a magnetic field of at least 200 Pa.

8. A magnetorheological fluid as recited in claim 7 having stability at temperatures up to about 200° C., said liquid vehicle composition having a molecular weight of at least 500.

9. A magnetorheological fluid as recited in claim 7 having stability at temperatures up to about 200° C., said liquid vehicle composition having a molecular weight in the range of about 500 to 1000.

* * * * *